US009288857B2

(12) United States Patent
Chiu

(10) Patent No.: US 9,288,857 B2
(45) Date of Patent: Mar. 15, 2016

(54) LIGHT-EMITTING DIODE DRIVING APPARATUS AND LIGHT-EMITTING DIODE ILLUMINATION SYSTEM USING THE SAME

(71) Applicant: FSP TECHNOLOGY INC., Taoyuan County (TW)

(72) Inventor: Chun-Chi Chiu, Taoyuan County (TW)

(73) Assignee: FSP TECHNOLOGY INC., Taoyuan (TW)

( * ) Notice: Subject to any disclaimer, the term of this patent is extended or adjusted under 35 U.S.C. 154(b) by 0 days.

(21) Appl. No.: 14/332,397

(22) Filed: Jul. 16, 2014

(65) Prior Publication Data

US 2015/0022106 A1 Jan. 22, 2015

(30) Foreign Application Priority Data

Jul. 22, 2013 (CN) ..... 2013 1 0308856

(51) Int. Cl.
*H05B 37/02* (2006.01)
*H05B 33/08* (2006.01)

(52) U.S. Cl.
CPC ..... *H05B 33/0815* (2013.01); *H05B 33/0848* (2013.01)

(58) Field of Classification Search
CPC ..... H05B 33/0803; H05B 33/0827; H05B 33/0815
USPC ..... 315/185 R, 192, 291, 294, 297, 315/307–308, 312
See application file for complete search history.

(56) References Cited

U.S. PATENT DOCUMENTS 7,479,738 B2 * 1/2009 Lin ..... H05B 33/0851 315/185 R
8,148,907 B2 * 4/2012 Sadwick ..... H05B 33/0815 315/246
8,525,423 B2 * 9/2013 Yu ..... G09G 3/3406 315/185 R
8,598,805 B2 * 12/2013 Tremblay ..... F21K 9/135 315/291
2007/0188112 A1 * 8/2007 Kang ..... H05B 33/0815 315/291
2009/0134817 A1 * 5/2009 Jurngwirth ..... H05B 33/0851 315/307
2010/0220049 A1 * 9/2010 Murakami ..... H05B 33/0815 345/102
2012/0074868 A1 * 3/2012 Tseng ..... H05B 33/0815 315/294
2012/0176046 A1 * 7/2012 Tsai ..... H05B 33/0851 315/185 R
2013/0257279 A1 * 10/2013 Le ..... H05B 33/0812 315/113

FOREIGN PATENT DOCUMENTS

TW M440615 11/2012

* cited by examiner

*Primary Examiner* — Jason M Crawford
(74) *Attorney, Agent, or Firm* — Jianq Chyun IP Office

(57) ABSTRACT

A LED driving apparatus and a LED illumination system using the same are provided. The LED driving apparatus adapted to drive a LED load having at least one power specification includes a driving circuit, an output detecting circuit and an output adjusting circuit. The driving circuit provides an adjustable output current for driving the LED load. The output detecting circuit is coupled to the driving circuit and the LED load for detecting a driving voltage of the LED load to generate a first detecting signal. The driving circuit drives the LED load under a constant current in response to the first detecting signal. The output adjusting circuit is coupled to the output detecting circuit. The output adjusting circuit is controlled to adjust a signal level of the first detecting signal, such that the adjustable output current has at least one current adjusting range.

11 Claims, 3 Drawing Sheets

LIGHT-EMITTING DIODE DRIVING APPARATUS AND LIGHT-EMITTING DIODE ILLUMINATION SYSTEM USING THE SAME

CROSS-REFERENCE TO RELATED APPLICATION

This application claims the priority benefit of China application serial no. 201310308856.0, filed on Jul. 22, 2013. The entirety of the above-mentioned patent application is hereby incorporated by reference herein and made a part of this specification.

BACKGROUND

1. Technical Field

The invention relates to a light-emitting diode (LED) driving apparatus and application thereof, and particularly relates to a LED driving apparatus capable of adjusting an output current and a LED illumination system using the same.

2. Related Art

Along with development of semiconductor technology, lighting brightness and lighting efficiency of light-emitting diode (LED) are continuously improved. The LED is a novel cold light source, and has advantages of long service life, small volume, low power consumption, low pollution, high reliability, suitable for mass production, etc., and an application range of the LED is very wide (for example, illumination apparatus, liquid crystal display (LCD) or backlight source of large billboard, etc.).

Generally, LED lamps developed by different manufactures respectively have a certain power specification requirement, so that a provider of the LED driving apparatuses has to respectively design corresponding LED driving apparatuses according to the power specification requirements of the manufacturers. However, specifications of the current LED lamps are diversified, so that a demand on variation range of an input voltage and an input current is rather high. Therefore, the provider of the LED driving apparatuses often needs to redesign various parameters of the LED driving circuits to satisfy requirements of clients, which often causes waste of time and development cost.

SUMMARY

The invention is directed to a light-emitting diode (LED) driving apparatus and a LED illumination system using the same, which are capable of dynamically adjusting an output current to cope with a power specification requirement of corresponding LED lamp.

The invention provides a LED driving apparatus, which is adapted to drive a LED load having at least one power specification. The LED driving apparatus includes a driving circuit, an output detecting circuit and an output adjusting circuit. The driving circuit provides an adjustable output current for driving the LED load. The output detecting circuit is coupled to the driving circuit and the LED load, and is configured to detect a driving voltage of the LED load to generate a first detecting signal, where the driving circuit drives the LED load under a constant current in response to the first detecting signal. The output adjusting circuit is coupled to the output detecting circuit, where the output adjusting circuit is controlled to adjust a signal level of the first detecting signal, such that the adjustable output current has at least one current adjusting range.

In an embodiment of the invention, the output adjusting circuit is controlled according to the corresponding power specification of the LED load, such that the adjustable output current is adjusted to a current value matched with the power specification of the LED load within the at least one current adjusting range.

In an embodiment of the invention, a current variation of the adjustable output current within the at least one current adjusting range corresponds to an impedance variation of the output adjusting circuit.

In an embodiment of the invention, the current adjusting ranges are not overlapped to each other.

In an embodiment of the invention, a part of or all of the current adjusting ranges are partially overlapped.

In an embodiment of the invention, the output adjusting circuit includes a variable resistance unit. The output detecting circuit adjusts the signal level of the first detecting signal in response to a resistance variation of the variable resistance unit.

In an embodiment of the invention, the output adjusting circuit includes a plurality of switch units. The switch units are connected in parallel with the variable resistance unit. The switch units respectively include a resistor and a switch connected in series, where the switches are controlled to electrically connect the corresponding resistors to the output detecting circuit, and the output detecting circuit adjusts the signal level of the first detecting signal in response to equivalent resistance values of the electrically connected resistors and the variable resistance unit.

In an embodiment of the invention, the driving circuit includes an alternating current (AC) conversion circuit and a direct current (DC) conversion circuit. The AC conversion circuit receives an AC power, and converts the AC power into a DC power. The DC conversion circuit is coupled to the AC conversion circuit for receiving the DC power, and converts the DC power into the adjustable output current.

In an embodiment of the invention, the output detecting circuit feeds back the first detecting signal to the DC conversion circuit, and the DC conversion circuit controls the output adjustable output current in response to the first detecting signal.

In an embodiment of the invention, the LED driving apparatus further includes a detecting circuit. The detecting circuit is coupled to the AC conversion circuit for detecting a power variation of the DC power, so as to generate a second detecting signal, where the AC conversion circuit adjusts a power of the output DC power in response to the second detecting signal.

The invention provides a LED illumination system including a LED lamp and a LED driving apparatus. The LED lamp has at least one power specification. The LED driving apparatus is coupled to the LED lamp, where the LED driving apparatus includes a driving circuit, an output detecting circuit and an output adjusting circuit. The driving circuit provides an adjustable output current for driving the LED lamp. The output detecting circuit is coupled to the driving circuit and the LED lamp for detecting a driving voltage of the LED lamp to generate a first detecting signal, where the driving circuit drives the LED lamp under a constant current in response to the first detecting signal. The output adjusting circuit is coupled to the output detecting circuit, where the output adjusting circuit is controlled to adjust a signal level of the first detecting signal, such that the adjustable output current has at least one current adjusting range.

According to the above descriptions, the embodiments of the invention provide the LED driving apparatus and the LED illumination system using the same. In the LED driving apparatus, a designer selects any current value within a specific current adjusting range to serve as the adjustable output current of the LED driving apparatus by adjusting the impedance of the output adjusting circuit. The designer can quickly design the LED driving apparatus having different output current specifications by only controlling the output adjusting circuit, such that the LED driving apparatus can be widely applied to the LED lamps of different specifications. Since it is unnecessary to consume extra cost to design the corresponding driving apparatus for the LED lamp of each different specification, the development cost and time are effectively decreased.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
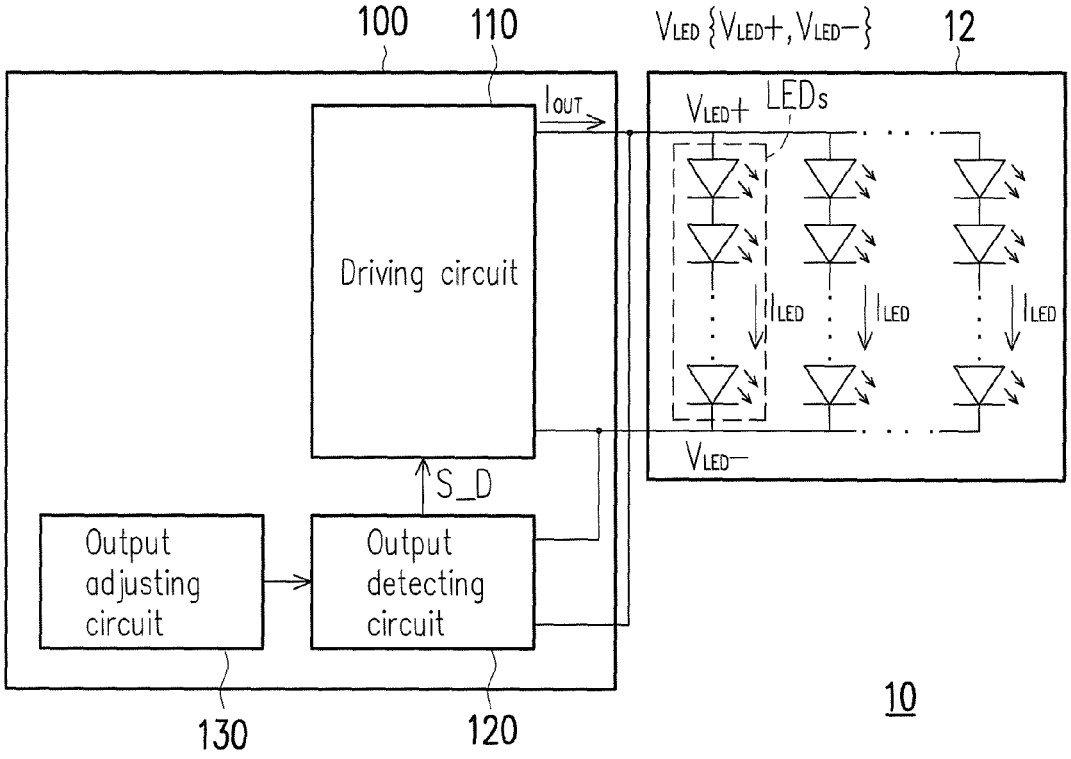
FIG. 1 is a schematic diagram of a LED illumination system according to an embodiment of the invention.

Embodiments of the invention provide a light-emitting diode (LED) driving apparatus and a LED illumination system using the same. In the LED driving apparatus, a designer can select any current value within a specific current adjusting range to serve as an output current of the LED driving apparatus by adjusting an impedance of an output adjusting circuit. The designer can quickly design the LED driving apparatus having different output current specifications by only controlling the output adjusting circuit, such that the LED driving apparatus can be widely adapted to the LED lamps of different specifications. Since it is unnecessary to consume extra cost to design the corresponding driving apparatus for the LED lamp of each different specification, the development cost and time are effectively decreased. In order to fully convey the spirit of the invention, embodiments are provided below for descriptions. Moreover, wherever possible, components/members/steps using the same referential numbers in the drawings and descriptions refer to the same or like parts.

FIG. 1 is a schematic diagram of a LED illumination system according to an embodiment of the invention. Referring to FIG. 1, the LED illumination system 10 includes a LED load (for example, a LED lamp 12) and a LED driving apparatus 100 used for driving the LED load. In the present embodiment, the LED lamp 12 may include one set or plural sets of LED strings LEDs connected in parallel to each other, and each of the LED strings LEDs may include one or a plurality of LEDs connected in series, where the LED lamp 12 has a corresponding power specification according to configuration and design thereof.

The LED driving apparatus 100 includes a driving circuit 110, an output detecting circuit 120 and an output adjusting circuit 130, where the circuits 110, 120 and 130 are constructed as the LED driving apparatus 100 by a modular configuration. The driving circuit 110 provides an adjustable output current $I_{OUT}$ for driving the LED strings LEDs in the LED lamp 12. To be specific, the driving circuit 110 generates a driving voltage $V_{LED}$ at two ends of the LED strings LEDs, such that each of the LED strings LEDs is operated under a driving current $I_{LED}$ in response to a potential difference created by the driving voltage $V_{LED+}$ and $V_{LED-}$ at an anode terminal and a cathode terminal thereof A sum of the driving current $I_{LED}$ of each of the LED strings LEDs is the adjustable output current $I_{OUT}$ of the driving circuit 110.

The output detecting circuit 120 is coupled to the driving circuit 110, for detecting the driving voltage $V_{LED}$ to generate a detecting signal S_D. The driving circuit 110 adjusts a voltage level of the driving voltage $V_{LED}$ according to the detecting signal S_D, so as to maintain the driving current $I_{LED}$ of each of the LED strings LEDs to a specific current value, and accordingly maintain the LED lamp 12 to a stable brightness.

The output adjusting circuit 130 is coupled to the output detecting circuit 120. The output adjusting circuit 130 is controlled to adjust a signal level of the detecting signal S_D, such that the adjustable output current $I_{OUT}$ of the driving circuit 110 is varied along with an impedance variation of the output adjusting circuit 130. In other words, the adjustable output current $I_{OUT}$ of the driving circuit 110 has a current adjusting range along with an impedance adjustable amplitude of the output adjusting circuit 130. A current variation of the adjustable output current $I_{OUT}$ within the current adjusting range corresponds to an impedance variation of the output adjusting circuit 130 (for example, a proportional relationship or an inversely proportional relationship).

Compared to a conventional LED driving apparatus, the LED driving apparatus 100 of the invention can dynamically adjust a magnitude of the adjustable output current $I_{OUT}$ by controlling the output adjusting circuit 130, such that the LED driving apparatus 100 is adapted to drive any LED lamp 12 having the power specification within the current adjusting range. In this way, application compatibility of the LED driving apparatus 100 is greatly improved.

Figure 2A:
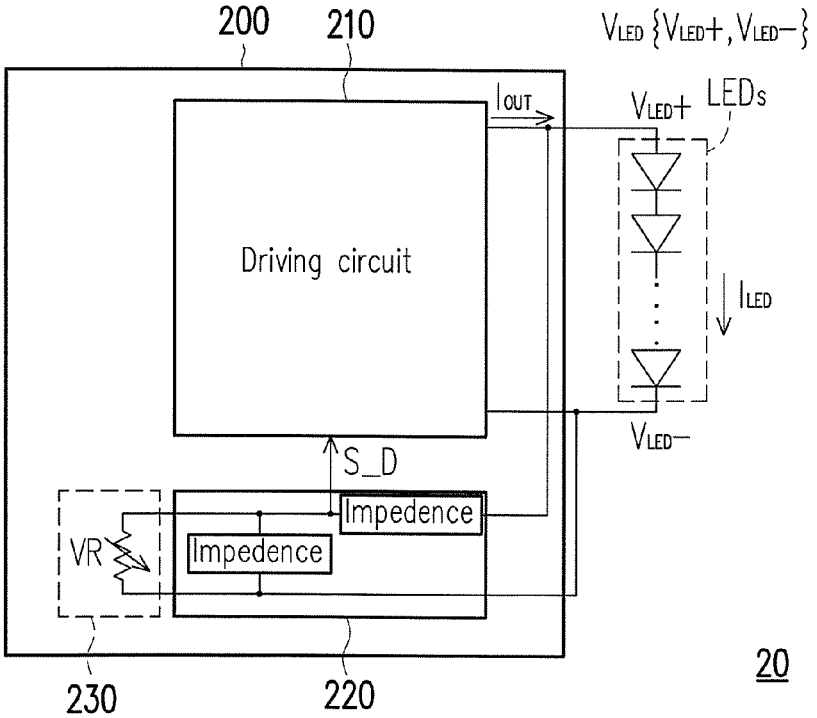
FIG. 2A and FIG. 2B are schematic diagrams of a LED illumination system implemented by using different output adjusting circuit structures.
Figure 2B:
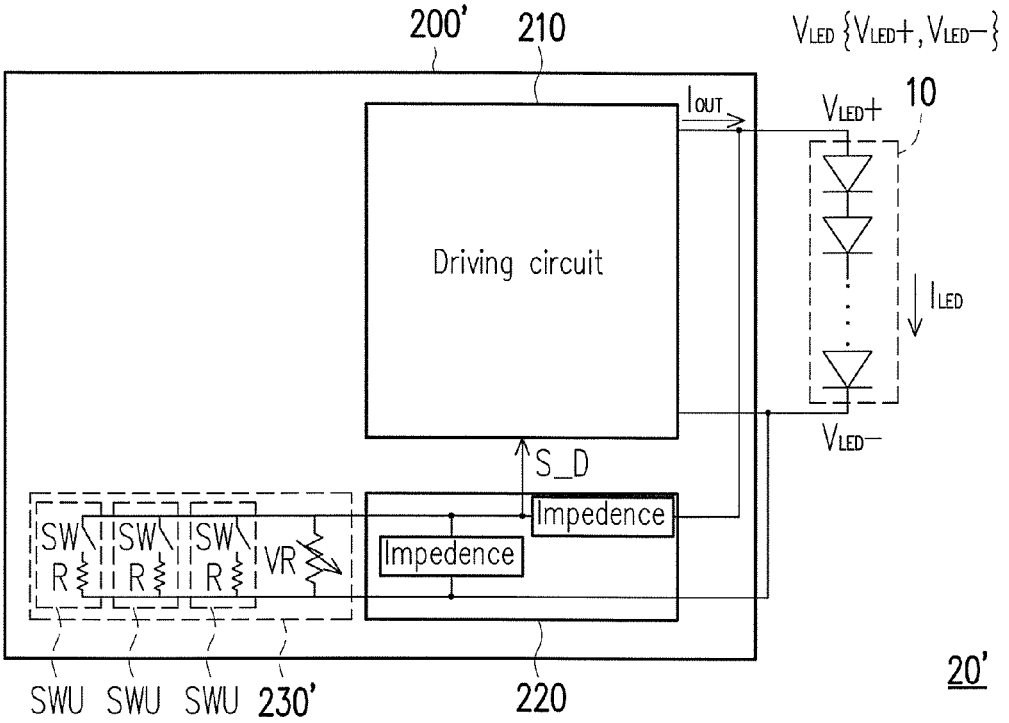

In order to clearly describe the invention, embodiments are provided below, FIG. 2A and FIG. 2B are schematic diagrams of a LED illumination system implemented by using different output adjusting circuit structures. Referring to FIG. 2A, in the present embodiment, the output adjusting circuit 230 is implemented by using a variable resistance unit VR. The output detecting circuit 220 adjusts the signal level of the detecting signal S_D in response to a resistance variation of the variable resistance unit VR, and the driving circuit 210 outputs the corresponding adjustable output current $I_{OUT}$.

In detail, in the design of the output detecting circuit (shown as a block 220 in FIG. 2A and FIG. 2B), a voltage-dividing circuit is generally used to detect the driving voltage $V_{LED+}$ at the anode terminal of the LED string LEDs or the driving voltage $V_{LED-}$ at the cathode terminal thereof, and the voltage-divided driving voltage $V_{LED+}$ or $V_{LED-}$ is taken as the detecting signal S_D to the driving circuit 210. As shown in FIG. 2A and FIG. 2B, the voltage-dividing circuit including two impedances are shown in the block 220 as an embodiment for implementing the output detecting circuit. The impedances can be regarded as a voltage divider and the divided voltage can be presented as the detecting signal S_D. It clear shows the output adjusting circuit 230, which can be implemented by at least a variable resistance unit VR, is connected to one of the impedances in parallel. In the present embodiment, the output adjusting circuit 230 is, for example, the variable resistance unit VR connected in parallel to a voltage-dividing node of the voltage-dividing circuit. Based on the above structure, the designer can adjust the signal level of the detecting signal S_D by adjusting the resistance value of the variable resistance unit VR, so as to implement the function of adjusting the adjustable output current $I_{OUT}$. Moreover, under such structure, the adjustable output current $I_{OUT}$ may have a corresponding current adjusting range based on a resistance adjusting range of the variable resistance unit VR. For example, the predetermined adjustable output current $I_{OUT}$ is 350 mA, and the resistance adjusting range of the variable resistance unit VR is capable of providing an adjusting range of ±50 mA for the adjustable output current $I_{OUT}$. Therefore, the current adjusting range of the adjustable output current $I_{OUT}$ is 300 mA-400 mA.

On the other hand, referring to FIG. 2B, in the present embodiment, the output adjusting circuit 230' is implemented by a plurality of switch units SWU and a variable resistance unit VR. In the output adjusting circuit 230', the switch units SWU are connected in parallel with the variable resistance unit VR, and the switch units SWU respectively include a resistor R and a switch SW connected in series. In each of the switch units SWU, the switch SW can be turned on or turned off, so as to electrically connect the corresponding resistor R to the output detecting circuit 220. Therefore, the output detecting circuit 220 can adjust the signal level of the detecting signal SD in response to variation of equivalent resistance values of the electrically connected resistors R and the variable resistance unit VR, such that the driving circuit 210 can output the corresponding adjustable output current $I_{OUT}$. In the present embodiment, a detailed circuit structure configuration between the output adjusting circuit 230' and the output detecting circuit 220 may refer to the embodiment of FIG. 2A. Moreover, the switch SW is, for example, a dip switch.

The designer can also adjust the current value of the adjustable output current $I_{OUT}$ output by the driving circuit 210 by controlling the output adjusting circuit 230/230' according to the power specification of the corresponding LED lamp 12, such that the adjustable output current $I_{OUT}$ is adjusted to a current value matched with the power specification of the LED lamp 12 within the current adjusting range in response to the impedance variation of the output adjusting circuit 230/230'.

In detail, the LED driving apparatus 200' may implement a function of adjusting the adjustable output current $I_{OUT}$ in multi-level based on configuration of each of the switch units SWU (i.e. a conduction state of each of the switches SW). Moreover, the LED driving apparatus 200' can further fine tune the adjustable output current $I_{OUT}$ of each level by adjusting the resistance value of the variable resistance unit VR. In other words, under the structure of the LED driving apparatus 200', the adjustable output current $I_{OUT}$ may have a plurality of different current adjusting ranges.

For example, the adjustable output current $I_{OUT}$ can be switched to 350 mA/500 mA/700 mA according to configuration of the switch units SWU, and the resistance adjusting range of the variable resistance unit VR is capable of providing an adjusting range of ±50 mA for the adjustable output current $I_{OUT}$, the adjustable output current $I_{OUT}$ at least have three current adjusting ranges of 300 mA-400 mA, 450 mA-550 mA and 650 mA-750 mA, etc. Under such structure, the application compatibility of the LED driving apparatus 200' of the present embodiment is further improved.

In the present embodiment, according to the resistance value of each of the resistors R and the resistance adjusting range of the variable resistance value VR, the current adjusting ranges may have diversified patterns, for example, the current adjusting ranges are not overlapped to each other or the current adjusting ranges are partially overlapped to each other. In the pattern that the current adjusting ranges are not overlapped, current adjusting ranges can be discontinuous (for example, the current adjusting ranges are respectively 300 mA-400 mA, 450 mA-550 mA and 650 mA-750 mA), or the current adjusting ranges can be continuous (for example, the current adjusting ranges are respectively 300 mA-400 mA, 400 mA-500 mA and 500 mA-600 mA). Moreover, in the pattern that the current adjusting ranges are partially overlapped, a part of the current adjusting ranges are partially overlapped (for example, the current adjusting ranges are respectively 350 mA-450 mA, 400 mA-500 mA and 550 mA-650 mA), or all of the current adjusting ranges are partially overlapped (for example, the current adjusting ranges are respectively 350 mA-450 mA, 400 mA-500 mA and 450 mA-550 mA). The aforementioned current adjusting ranges are possible implementations of the invention.

Figure 3:
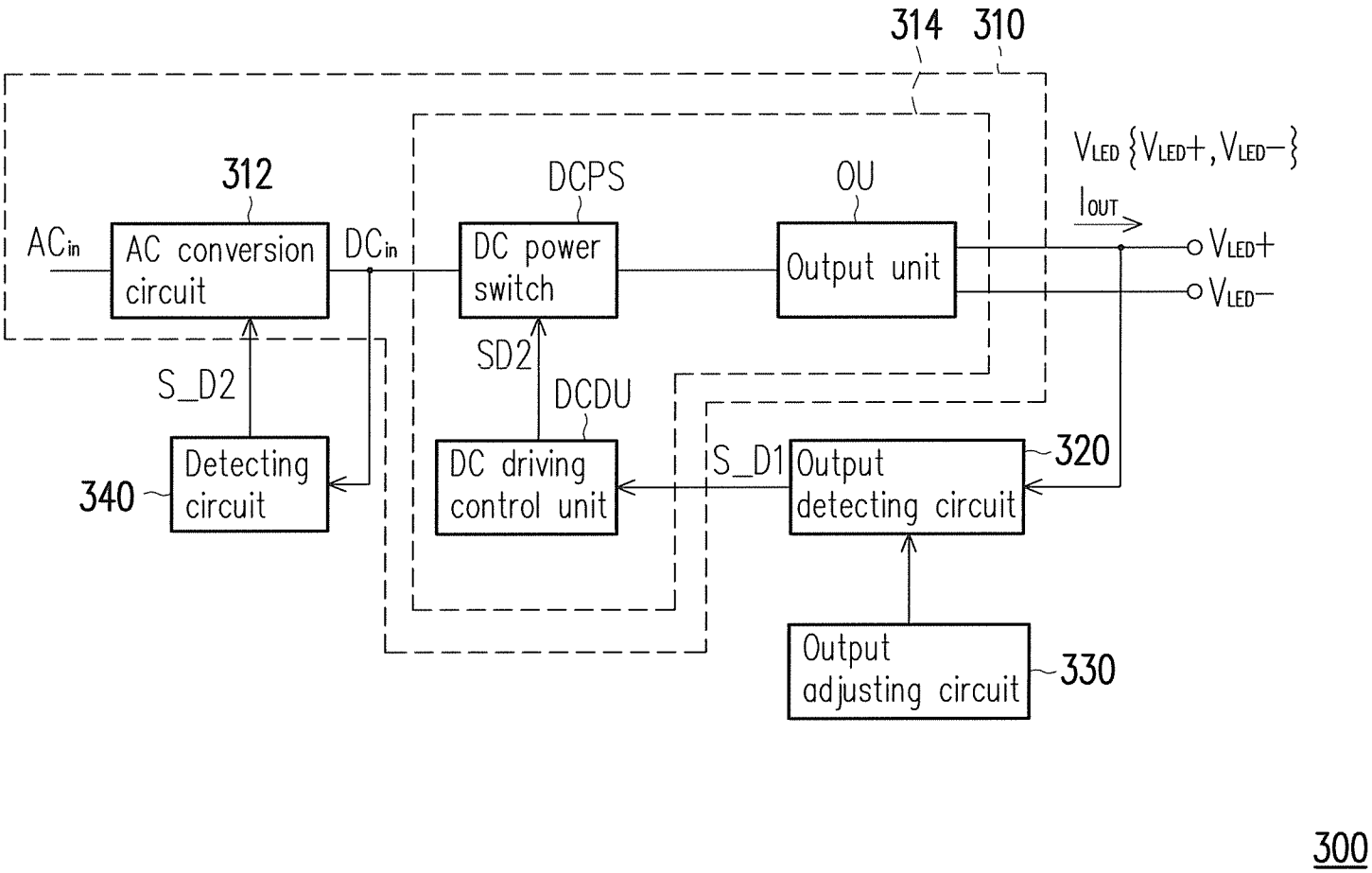
FIG. 3 is a schematic diagram of a LED driving apparatus according to an embodiment of the invention.

FIG. 3 is a schematic diagram of a LED driving apparatus according to an embodiment of the invention. Referring to FIG. 3, the LED driving apparatus 300 includes a driving circuit 310, an output detecting circuit 320 and an output adjusting circuit 330. The driving circuit 310 further includes an AC conversion circuit 312 and a DC conversion circuit 314.

After receiving an AC power ACin, the AC conversion circuit 312 performs an AC-DC conversion to the AC power ACin and outputs a DC power DCin to the DC conversion unit 314. On the other hand, after the DC conversion circuit 314 receives the DC power DCin, the DC conversion circuit 314 performs a boost/buck processing on the received DC power DCin to convert the DC power DCin into the corresponding adjustable output current $I_{OUT}$, and provides the same to the LED load.

In detail, the DC conversion circuit 314, for example, includes a DC power switch DCPS, a DC driving control unit DCDU and an output unit OU. In the present embodiment, the DC power switch DCPS switches a conduction state thereof according to a driving signal SD2 provided by the DC driving control unit DCDU, so as to provides the DC power DCin generated by the AC conversion circuit 312 to the output unit OU. The output unit OU can be set to a buck-type passive circuit configuration (for example, a circuit configuration of serial inductance and parallel capacitance), or a boost-type passive circuit configuration (for example, a circuit configuration of parallel inductance and parallel capacitance), such that the output unit OU performs the boost/buck processing on the DC power DCin in collaboration with switching of the DC power switch DCPS, and generates the adjustable output current $I_{OUT}$.

In the present embodiment, the AC conversion circuit 312 converts the AC power ACin into the DC power DCin for providing a stable DC voltage to the DC conversion circuit 314. The output detecting circuit 320 detects the driving voltage $V_{LED+}$ at the anode terminal, and provides the detecting signal S_D1 to the DC driving control unit DCDU in the DC conversion circuit 314. Then, the DC driving control unit DCDU adjusts a duty cycle of the provided driving signal SD2 in response to the detecting signal S_D1, such that a switching frequency of the DC power switch DCPS is correspondingly changed. Under such structure, by controlling an impedance variation of the output adjusting circuit 330, the DC driving control unit DCDU generates the corresponding driving signal SD2 to control the DC power switch DCPS in response to a different detecting signal S_D1, so as to implement adjusting the adjustable output current $I_{OUT}$.

On the other hand, since the AC conversion circuit 312 is required to provide the DC power DCin having the same power with that of the LED load to the DC conversion circuit 314, for example, when the driving voltage $V_{LED}$ of the LED load is equal to 70V and the output current $I_{OUT}$ is equal to 1 A, it represents that the required power is 70 W, and now the AC conversion circuit 312 is required to provide the DC power DCin of 70 W to the DC conversion circuit 314 (i.e. when the DC voltage of 80V is stably output, the AC conversion circuit 312 is required to output a current of 0.875 A), so that in the LED driving apparatus 300 of the present embodiment, a detecting circuit 340 is additionally set. The detecting circuit 340 is configured to detect a power variation or a current variation of the DC power DCin output by the AC conversion circuit 312, and outputs a detecting signal S_D2 to the AC conversion circuit 312. The AC conversion circuit 312 adjusts the power of the DC power DCin in response to the detecting signal S_D2 for providing a corresponding current to the DC conversion circuit 314.

In other words, in the present embodiment, the LED driving apparatus 300 directly adjusts the adjustable output current $I_{OUT}$ output by the DC conversion circuit 314. Therefore, under the structure of the present embodiment, a DC conversion power of the DC conversion circuit 314 is changed in response to the impedance variation of the output adjusting circuit 330, and an AC conversion power of the AC conversion circuit 312 is changed along with change of the DC conversion power of the DC conversion circuit 314.

According to the embodiment of FIG. 3, those skilled in the art should understand that the LED driving apparatus of the invention can implement adjusting the adjustable output current $I_{OUT}$ through control of the AC conversion circuit 312 or the DC conversion circuit 314, which is not limited to one of the implementations. Further, any structure capable of controlling an impedance variation of an output adjusting circuit, such that the adjustable output current has at least one current adjusting range is considered to be within the scope of the invention.

It should be noticed that in the embodiment of FIG. 3, the output detecting circuit 320 detecting the driving voltage $V_{LED+}$ at the anode terminal is taken as an example for description, though in other embodiments, the driving voltage $V_{LED-}$ at the cathode terminal can be detected to generate the detecting signal S_D1, which is not limited by the invention.

In summary, the embodiments of the invention provide the LED driving apparatus and the LED illumination system using the same. In the LED driving apparatus, a designer can select any current value within a specific current adjusting range to serve as the adjustable output current of the LED driving apparatus by adjusting the impedance of the output adjusting circuit. The designer can quickly design the LED driving apparatus having different output current specifications by only controlling the output adjusting circuit, such that the LED driving apparatus can be widely applied to the LED lamps of different specifications. Since it is unnecessary to consume extra cost to design the corresponding driving apparatus for the LED lamp of each different specification, the development cost and time are effectively decreased.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A light-emitting diode (LED) driving apparatus, adapted to drive a LED load having at least a first power specification and a second power specification different from the first power specification, the LED driving apparatus comprising:

a driving circuit, providing an adjustable output current for driving the LED load having the first power specification;

an output detecting circuit, coupled to the driving circuit and the LED load, and detecting a driving voltage of the LED load to generate a first detecting signal, wherein the driving circuit drives the LED load under a constant current in response to the first detecting signal; and an output adjusting circuit, coupled to the output detecting circuit, wherein the output adjusting circuit is controlled to adjust a signal level of the first detecting signal, such that the adjustable output current has at least one current adjusting range for driving the LED load having the second power specification.

2. The LED driving apparatus as claimed in claim 1, wherein the output adjusting circuit is controlled according to the second power specification of the LED load, such that the adjustable output current is adjusted to a current value matched with the second power specification of the LED load within the at least one current adjusting range.

3. The LED driving apparatus as claimed in claim 1, wherein a current variation of the adjustable output current within the at least one current adjusting range corresponds to an impedance variation of the output adjusting circuit.

4. The LED driving apparatus as claimed in claim 1, wherein the output adjusting circuit comprises:

a variable resistance unit, wherein the output detecting circuit adjusts the signal level of the first detecting signal in response to a resistance variation of the variable resistance unit.

5. The LED driving apparatus as claimed in claim 4, wherein the output adjusting circuit comprises:

a plurality of switch units, connected in parallel with the variable resistance unit, and respectively comprising a resistor and a switch connected in series, wherein the switches are controlled to electrically connect the corresponding resistors to the output detecting circuit, and the output detecting circuit adjusts the signal level of the first detecting signal in response to equivalent resistance values of the electrically connected resistors and the variable resistance unit.

6. The LED driving apparatus as claimed in claim 1, wherein the driving circuit comprises:

an alternating current (AC) conversion circuit, receiving an AC power, and converting the AC power into a direct current (DC) power; and a DC conversion circuit, coupled to the AC conversion circuit to receive the DC power, and converting the DC power into the adjustable output current.

7. The LED driving apparatus as claimed in claim 6, wherein the output detecting circuit feeds back the first detecting signal to the DC conversion circuit, and the DC conversion circuit controls the output adjustable output current in response to the first detecting signal.

8. The LED driving apparatus as claimed in claim 7, further comprising:

a detecting circuit, coupled to the AC conversion circuit, and configured to detect a power variation of the DC power, so as to generate a second detecting signal, wherein the AC conversion circuit adjusts a power of the output DC power in response to the second detecting signal.

9. A LED illumination system, comprising:

a LED lamp, having at least a first power specification and a second power specification different from the first power specification; and a LED driving apparatus, coupled to the LED lamp, wherein the LED driving apparatus comprising:

a driving circuit, providing an adjustable output current for driving the LED lamp having the first power specification;

an output detecting circuit, coupled to the driving circuit and the LED lamp for detecting a driving voltage of the LED lamp to generate a first detecting signal, wherein the driving circuit drives the LED lamp under a constant current in response to the first detecting signal; and an output adjusting circuit, coupled to the output detecting circuit, wherein the output adjusting circuit is controlled to adjust a signal level of the first detecting signal, such that the adjustable output current has at least one current adjusting range for driving the LED load having the second power specification.

10. The LED illumination system as claimed in claim 9, wherein the output adjusting circuit is controlled according to the second power specification of the LED lamp, such that the adjustable output current is adjusted to a current value matched with the second power specification of the LED lamp within the at least one current adjusting range.

11. The LED illumination system as claimed in claim 9, wherein a current variation of the adjustable output current within the at least one current adjusting range corresponds to an impedance variation of the output adjusting circuit.

* * * * *